US010539358B2

(12) United States Patent
Suzuki et al.

(10) Patent No.: US 10,539,358 B2
(45) Date of Patent: Jan. 21, 2020

(54) AIR-CONDITIONING APPARATUS AND REFRIGERANT LEAKAGE DETECTION METHOD

(71) Applicant: Mitsubishi Electric Corporation, Tokyo (JP)

(72) Inventors: Yasuhiro Suzuki, Tokyo (JP); Takao Komai, Tokyo (JP); Akira Maeda, Tokyo (JP); Masafumi Tomita, Tokyo (JP); Masahiro Takamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 71 days.

(21) Appl. No.: 14/891,975

(22) PCT Filed: Jul. 29, 2014

(86) PCT No.: PCT/JP2014/069972
§ 371 (c)(1),
(2) Date: Nov. 18, 2015

(87) PCT Pub. No.: WO2015/029678
PCT Pub. Date: Mar. 5, 2015

(65) Prior Publication Data

US 2016/0091241 A1 Mar. 31, 2016

(30) Foreign Application Priority Data

Aug. 26, 2013 (JP) ..... 2013-174790

(51) Int. Cl.
*F25B 49/00* (2006.01)
*F24F 11/36* (2018.01)
(Continued)

(52) U.S. Cl.
CPC ..... *F25D 17/067* (2013.01); *F24F 11/83* (2018.01); *F25B 49/005* (2013.01); *F24F 11/36* (2018.01);
(Continued)

(58) Field of Classification Search
CPC ..... F24F 2011/0084; F24F 11/36; F25B 2700/2108; F25B 39/028; F25B 2500/22
See application file for complete search history.

(56) References Cited

U.S. PATENT DOCUMENTS 4,745,765 A * 5/1988 Pettitt ..... B60H 1/00585 62/129
4,856,288 A * 8/1989 Weber ..... B60H 1/00585 137/412
(Continued)

FOREIGN PATENT DOCUMENTS

CN 204100499 U 1/2015
EP 1 855 064 A1 11/2001
(Continued)

OTHER PUBLICATIONS

Office Action dated Sep. 26, 2016 issued in corresponding AU patent application No. 2014313328.
(Continued)

*Primary Examiner* — Nelson J Nieves
(74) *Attorney, Agent, or Firm* — Posz Law Group, PLC

(57) ABSTRACT

An indoor unit of an air-conditioning apparatus includes a header main pipe to which an indoor pipe is connected at a brazed portion and header branch pipes. The header branch pipes are connected to first ends of heat-transfer pipes included in an indoor heat exchanger at brazed portions. The indoor pipe is connected to indoor refrigerant branch pipes at brazed portions. The indoor refrigerant branch pipes are connected to second ends of the heat-transfer pipes. A first
(Continued)

leaked refrigerant receiver is disposed under the brazed portions. A first temperature sensor is disposed in the first leaked refrigerant receiver. A second leaked refrigerant receiver is disposed under flare joints connecting the indoor pipes to extension pipes, respectively. A second temperature sensor is disposed in the second leaked refrigerant receiver.

12 Claims, 10 Drawing Sheets

(51) Int. Cl.
*F25D 17/06* (2006.01)
*F24F 11/83* (2018.01)
*F25B 13/00* (2006.01)

(52) U.S. Cl.
CPC ..... *F25B 13/00* (2013.01); *F25B 2313/0314* (2013.01); *F25B 2500/222* (2013.01)

(56) References Cited

U.S. PATENT DOCUMENTS

| | | | | |
|---|---|---|---|---|
| 5,152,152 | A * | 10/1992 | Brickner | B60H 1/00978 62/126 |
| 6,330,802 | B1 * | 12/2001 | Cummings | B60H 1/00978 62/126 |
| 2002/0178738 | A1 * | 12/2002 | Taira | F25B 49/005 62/129 |
| 2004/0078974 | A1 * | 4/2004 | St. James | F16L 33/02 29/890.14 |
| 2005/0039469 | A1 * | 2/2005 | Nonaka | F25B 49/025 62/129 |
| 2005/0086952 | A1 * | 4/2005 | Nonaka | F25D 11/022 62/129 |
| 2008/0202738 | A1 * | 8/2008 | Nelson | F25B 39/028 165/174 |
| 2009/0094999 | A1 * | 4/2009 | Leatherbarrow | F25B 49/005 62/132 |
| 2011/0000234 | A1 * | 1/2011 | Nishimura | F25B 49/005 62/77 |
| 2011/0112814 | A1 * | 5/2011 | Clark | F25B 49/005 703/9 |
| 2011/0174059 | A1 * | 7/2011 | Yonemori | F25B 49/005 73/40 |
| 2011/0277541 | A1 * | 11/2011 | Kadle | B60H 1/00978 73/40.7 |
| 2012/0272672 | A1 * | 11/2012 | Morimoto | F25B 41/04 62/126 |
| 2013/0087204 | A1 * | 4/2013 | Beard | F25B 39/028 137/1 |
| 2013/0133359 | A1 | 5/2013 | Ueda et al. | |
| 2013/0180268 | A1 * | 7/2013 | Schlosser | F25C 1/12 62/66 |
| 2015/0007591 | A1 * | 1/2015 | Liu | G01K 13/02 62/77 |

FOREIGN PATENT DOCUMENTS

| | | | | |
|---|---|---|---|---|
| JP | H04-369370 | A | 12/1992 | |
| JP | H11-142004 | A | 5/1999 | |
| JP | 2000-081258 | A | 3/2000 | |
| JP | 2000-146393 | A | 5/2000 | |
| JP | 2000-258000 | A | 9/2000 | |
| JP | 2002-103952 | A | 4/2002 | |
| JP | 2002-228281 | A | 8/2002 | |
| JP | 2004-286255 | A | 10/2004 | |
| JP | 2010-078285 | A | 4/2010 | |
| JP | 2011-247571 | A | 12/2011 | |
| JP | 2013-047591 | A | 3/2013 | |
| JP | 2013-113555 | A | 6/2013 | |
| WO | WO 2013119489 | A2 * | 8/2013 | F25B 49/005 |

OTHER PUBLICATIONS

Extended European Search Report dated Feb. 27, 2017 issued in corresponding EP patent application No. 14840930.3.
Office Action dated Oct. 9, 2016 in the corresponding CN Patent application No. 201410424347.9 (and English translation).
International Search Report of the International Searching Authority dated Oct. 28, 2014 for the corresponding international application No. PCT/JP2014/069972 (and English translation).
Office Action dated Dec. 2, 2014 in the corresponding JP application No. 2013-174790 (with English translation).
Office Action dated May 7, 2015 in the corresponding JP application No. 2013-174790 (with English translation).
Office Action dated Sep. 1, 2017 issued in corresponding CN patent application No. 201410424347.9 (and English translation).
Office Action dated Apr. 19, 2017 issued in corresponding CN patent application No. 201410424347.9 (and partial English translation).
Office Action dated Feb. 20, 2019 issued in corresponding CN patent application No. 201410424347.9 (and English translation).
Office Action dated May 31, 2019 issued in corresponding MX patent application No. MX/a/20161002486 (and English translation).
Examination Report dated May 22, 2019 issued in corresponding IN patent application No. 201647007462 (and English translation).

* cited by examiner

AIR-CONDITIONING APPARATUS AND REFRIGERANT LEAKAGE DETECTION METHOD

CROSS REFERENCE TO RELATED APPLICATIONS

This application is a U.S. national stage application of International Application No. PCT/JP2014/069972 filed on Jul. 29, 2014, which claims priority to Japanese Patent Application No. 2013-174790 filed on Aug. 26, 2013, the disclosures of which are incorporated herein by reference.

TECHNICAL FIELD

The present invention relates to an air-conditioning apparatus and a refrigerant leakage detection method. The present invention particularly relates to an air-conditioning apparatus that performs a refrigeration cycle using a refrigerant with a low global warming potential, and a refrigerant leakage detection method for use in the air-conditioning apparatus.

BACKGROUND ART

Conventionally, "HFC refrigerants" such as non-flammable R410A have been used as a refrigerant for a refrigeration cycle performed by an air-conditioning apparatus. Unlike conventional "HCFC refrigerants" such as R22, R410A has an ozone depletion potential (hereinafter referred to as "ODP") of zero and does not damage the ozone layer. However, R410A has the property of a high global warming potential (hereinafter referred to as "GWP").

Therefore, as part of prevention of global warming, studies are underway to shift from HFC refrigerants with a high GWP such as R410A to refrigerants with a low GWP.

Candidates for such a low-GWP refrigerant include HC refrigerants such as natural refrigerants R290 ($C_3H_8$; propane) and R1270 ($C_3H_6$; propylene). However, unlike non-flammable R410A, these refrigerants are highly flammable, and therefore attention needs to be paid to refrigerant leakage.

Candidates for such a low-GWP refrigerant also include HFC refrigerants that do not have a carbon double bond in their composition, such as R32 ($CH_2F_2$; difluoromethane) with a lower GWP than R410A, for example.

Candidates for such a refrigerant also include halogenated hydrocarbons that are a type of HFC refrigerant, similar to R32, and that have a carbon double bond in their composition. Examples of such halogenated hydrocarbons include HFO-1234yf ($CF_3CF{=}CH_2$; tetrafluoropropene) and HFO-1234ze ($CF_3{-}CH{=}CHF$). Note that, to be distinguished from HFC refrigerants, such as R32, not having a carbon double bond in their composition, HFC refrigerants having a carbon double bond are often referred to as "HFO" using "O" in olefin (unsaturated hydrocarbons having a carbon double bond are called olefins).

These low-GWP HFC refrigerants (including HFO refrigerants) are not as highly flammable as HC refrigerants such as the natural refrigerant R290 ($C_3H_8$; propane), but are slightly flammable, unlike the non-flammable R410A. Therefore, as in the case of R290, attention needs to be paid to refrigerant leakage. Hereinafter, refrigerants that are flammable, including even those slightly flammable, are referred to as "flammable refrigerants".

In the case where a flammable refrigerant leaks into the indoor living space, the refrigerant concentration in the room increases and may reach a flammable concentration while the operation is stopped (while an indoor fan is not rotating). That is, a flammable concentration is not developed by slow leakage in cases such as when a pinhole is formed in a heat exchanger and when a flare joint is loose, because the leakage speed is low. However, a flammable concentration is likely to be developed by rapid leakage in cases such as when a connection portion between pipes is broken by an external force and when a flare joint comes off, because the leakage speed is high. Note that while the air-conditioning apparatus is in operation, even if the refrigerant leaks, the refrigerant concentration does not increase to a flammable concentration, because the indoor air is agitated and the leaked refrigerant is diffused.

In view of the above, there is disclosed a split type air-conditioning apparatus that includes a temperature sensor disposed at a position in a refrigerant circuit where liquid refrigerant is likely to accumulate, more specifically, at the lower part of a header of an indoor heat exchanger, and a refrigerant leakage determining unit, which determines that the refrigerant is leaking when the refrigerant temperature detected by the temperature sensor decreases at a speed higher than a predetermined speed while a compressor is stopped (see, for example, Patent Literature 1).

CITATION LIST

Patent Literature

Patent Literature 1: Japanese Unexamined Patent Application Publication No. 2000-81258 (page 3, FIG. 2)

SUMMARY OF INVENTION

Technical Problem

However, according to the split type air-conditioning apparatus disclosed in Patent Literature 1, the temperature sensor is disposed at a predetermined position in the refrigerant circuit, and a determination is made that the refrigerant is leaking if the temperature sensor detects a rapid reduction in temperature due to evaporation of the liquid refrigerant at the position where the temperature sensor is disposed. Therefore, there are the following problems.

(a) Since the refrigerant distribution in the refrigerant circuit is not always uniform while the refrigerant circuit is stopped, the liquid refrigerant does not always accumulate at the position where the temperature sensor is disposed. Therefore, in the case where the liquid refrigerant is not present, even when refrigerant leakage occurs, it is difficult to detect the occurrence of refrigerant leakage.

(b) Further, even if, after occurrence of refrigerant leakage, the liquid refrigerant moves to the position where the temperature sensor is disposed and a rapid reduction in temperature due to evaporation of the liquid refrigerant is detected, it is not possible to quickly detect the occurrence of refrigerant leakage because the movement of the liquid refrigerant takes time.

(c) Further, even if refrigerant leakage occurs when the liquid refrigerant is accumulated at the position where the temperature sensor is disposed, or even if the liquid refrigerant moves to the position where the temperature sensor is disposed after occurrence of refrigerant leakage, in the case where the amount of the accumulated liquid refrigerant or the amount of the liquid refrigerant having moved thereto is small, the refrigerant leakage may not be detected because the amount of temperature reduction (the amount of heat removal) is small.

(d) Further, since the temperature sensor is disposed in a pipe forming the refrigerant circuit or in a liquid storing part formed in a pipe, even if the temperature of the liquid refrigerant decreases rapidly, the occurrence of refrigerant leakage may not be detected quickly, or refrigerant leakage itself may not be detected, because a change in temperature that is detected by the temperature sensor is reduced due to the heat capacity (heat inertia) of the pipe or the liquid storing part.

The present invention has been made to overcome the above problems, and aims to provide an air-conditioning apparatus and a refrigerant leakage detection method capable of quickly and reliably detecting refrigerant leakage.

Solution to Problem

An air-conditioning apparatus according to the present invention includes an outdoor unit including at least a compressor and an outdoor pipe, an indoor unit including at least an indoor heat exchanger, an indoor fan, and an indoor pipe, an extension pipe connecting the outdoor pipe and the indoor pipe to each other, a first temperature sensor disposed under a connection portion connecting the indoor heat exchanger and the indoor pipe to each other, and a control unit configured to determine whether a refrigerant having a higher specific gravity than indoor air is leaking from the connection portion, on the basis of a change in a temperature detected by the first temperature sensor, while the indoor fan is stopped.

Advantageous Effects of Invention

According to the present invention, the first temperature sensor is disposed under the connection portion connecting the heat exchanger and the indoor pipe to each other where refrigerant is likely to leak in a housing of the indoor unit. Therefore, if a refrigerant having a higher specific gravity than indoor air leaks from the connection portion, the first temperature sensor can directly detect a reduction in temperature of the atmosphere (leaked refrigerant itself; in some cases, ambient air is included) due to the vaporization heat (heat removal) at the time of adiabatic expansion of the leaked refrigerant. Thus, it is possible to quickly and accurately detect leakage of the refrigerant at an early stage of the occurrence of refrigerant leakage (at a time point when the cumulative amount of leakage is relatively low), without being affected by the heat capacity of the pipe or another related component.

DESCRIPTION OF EMBODIMENTS

Embodiment 1

Figure 1:
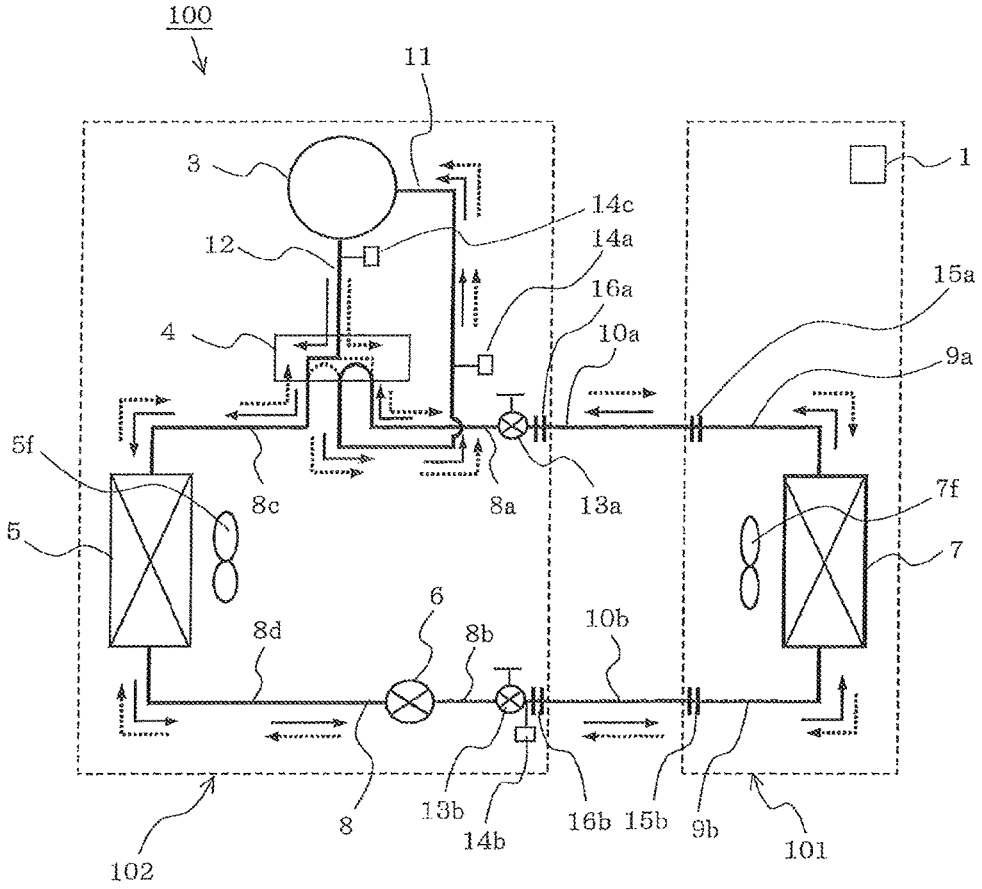
FIG. 1 is a refrigerant circuit diagram schematically illustrating the configuration of a refrigerant circuit of an air-conditioning apparatus according to Embodiment 1 of the present invention.
Figure 2:
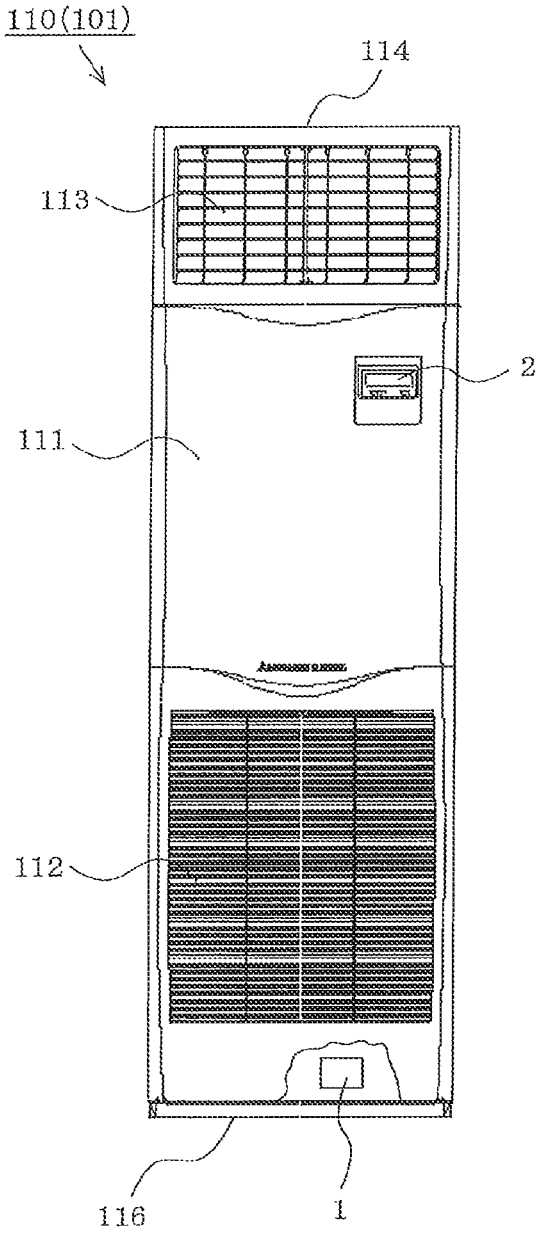
FIG. 2 is a front view illustrating the appearance of an indoor unit of the air-conditioning apparatus according to Embodiment 1 of the present invention.
Figure 3:
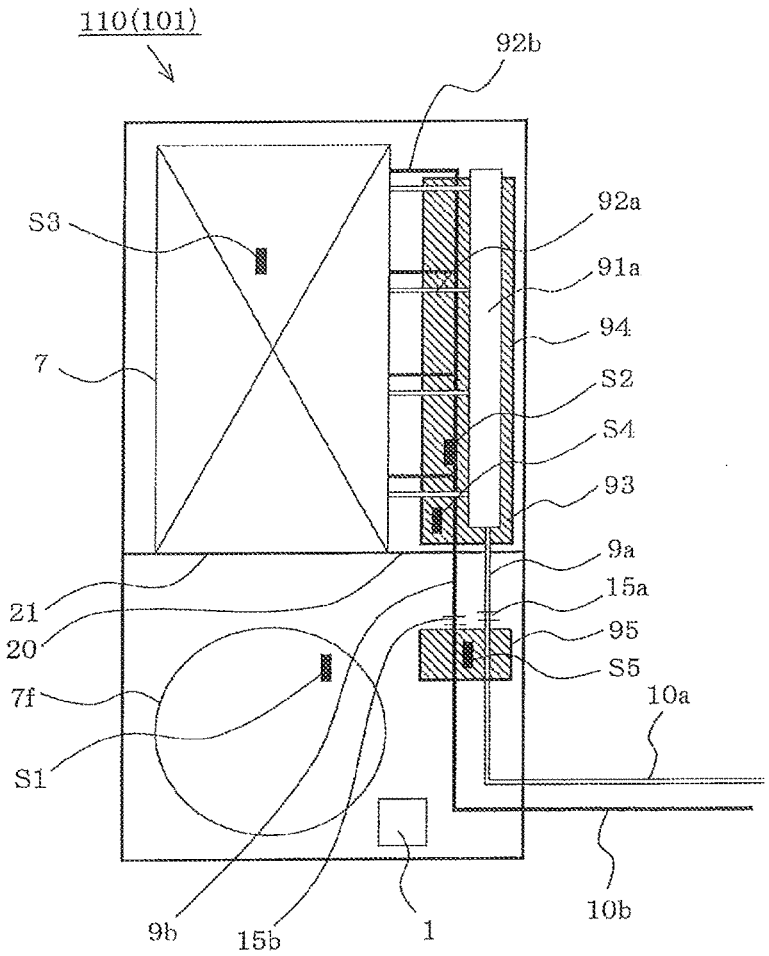
FIG. 3 is a partially transparent front view illustrating the internal configuration of the indoor unit of FIG. 2.
Figure 4:
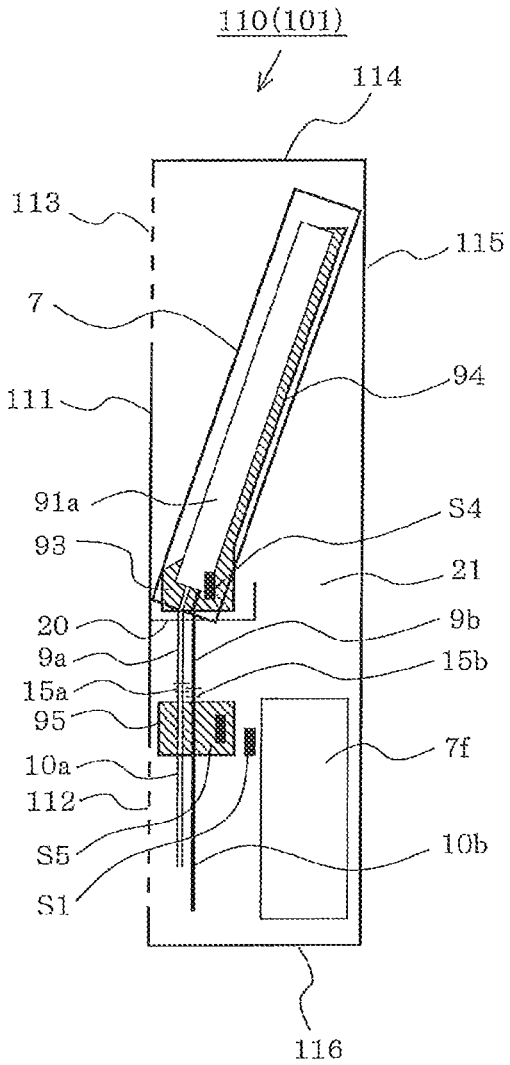
FIG. 4 is a partially transparent side view illustrating the internal configuration of the indoor unit of FIG. 2.

FIGS. 1 to 4 are diagrams for explaining an air-conditioning apparatus according to Embodiment 1 of the present invention. FIG. 1 is a refrigerant circuit diagram schematically illustrating the configuration of a refrigerant circuit. FIG. 2 is a front view illustrating the appearance of an indoor unit. FIG. 3 is a partially transparent front view illustrating the internal configuration of the indoor unit. FIG. 4 is a partially transparent side view illustrating the internal configuration of the indoor unit. Note that the drawings are schematic, and the present invention is not limited to the embodiment illustrated in the drawings.

In FIG. 1, an air-conditioning apparatus 100 is a separate type air-conditioning apparatus including an indoor unit (i.e., a load-side unit) 101 that is installed in the room, an outdoor unit (i.e., a heat-source-side unit) 102 that is installed in outdoors (not illustrated), extension pipes 10*a* and 10*b* connecting the indoor unit 101 and the outdoor unit 102 to each other.

Further, a control unit 1 is disposed in the indoor unit 101. As will be described below, the control unit 1 controls respective components and determines whether refrigerant is leaking.

(Refrigerant Circuit of Outdoor Unit)

The outdoor unit 102 includes a compressor 3 that compresses and discharges refrigerant, a refrigerant flow switching valve (hereinafter referred to as a "four-way valve") 4 that changes the flow direction of the refrigerant in the refrigerant circuit on switching between a cooling operation and a heating operation, an outdoor heat exchanger 5 as a heat-source-side heat exchanger that exchanges heat between the outdoor air and the refrigerant, and a pressure reducing device (hereinafter referred to as an expansion valve) 6 as an expanding unit, such as an electronically-controlled expansion valve, that has a variable opening degree and reduces the pressure of high-pressure refrigerant to a low pressure. These components are connected to each other by an outdoor pipe (i.e., a heat-source-side refrigerant pipe) 8.

Further, an outdoor fan 5*f* that supplies (blows) the outdoor air to the outdoor heat exchanger 5 is disposed to face the outdoor heat exchanger 5. An air flow that passes through the outdoor heat exchanger 5 is generated by rotating the outdoor fan 5*f*. In the outdoor unit 102, a propeller fan is used as the outdoor fan 5*f*, and the outdoor air is suctioned through the outdoor heat exchanger 5. The outdoor heat exchanger 5 is disposed at the downstream side of the air flow generated by the outdoor fan 5*f*.

(Outdoor Pipe)

The outdoor pipe 8 includes an outdoor pipe 8*a* connecting an extension pipe connecting valve 13*a* at the gas side (during a cooling operation) to the four-way valve 4, a suction pipe 11 connecting the four-way valve 4 to the compressor 3, a discharge pipe 12 connecting the compressor 3 to the four-way valve 4, an outdoor pipe 8*c* connecting the four-way valve 4 to the outdoor heat exchanger 5, an outdoor pipe 8*d* connecting the outdoor heat exchanger 5 to the expansion valve 6, and an outdoor pipe 8*b* connecting the expansion valve 6 to an extension pipe connecting valve 13*b* at the liquid side (during a cooling operation). The outdoor pipe 8 collectively refers to these components.

(Extension Pipe Connecting Valve)

The gas-side extension pipe connecting valve 13*a* is disposed on the outdoor pipe 8 at the connection portion to the gas-side extension pipe 10*a*. On the other hand, the liquid-side extension pipe connecting valve 13*b* is disposed on the outdoor pipe 8 at the connection portion to the liquid-side extension pipe 10*b*.

The gas-side extension pipe connecting valve 13*a* is a two-way valve capable of switching between the open and closed states, and a flare joint 16*a* is attached to an end thereof.

The liquid-side extension pipe connecting valve 13*b* is a three-way valve capable of switching between the open and closed states, and a service port 14*b* to be used on vacuuming (on preparatory work for supplying refrigerant to the air-conditioning apparatus 100) and a flare joint 16*b* are attached thereto.

An external thread is processed on the outdoor-pipe-8-side of each of the flare joints 16*a* and 16*b* attached to the extension pipe connecting valves 13*a* and 13*b* (including the service port 14*b*). At the time of shipment of the outdoor unit 102 (including the time of shipment of the air-conditioning apparatus 100), a flare nut (not illustrated) having an internal thread processed therein that engages the external thread is attached thereon.

(Service Port)

For convenience of explanation below, a part of the outdoor pipe 8 connecting the compressor 3 to the inlet of the four-way valve 4 at the discharge side of the compressor 3 is referred to as the discharge pipe 12, and a part connecting the four-way valve 4 to the compressor 3 at the suction side of the compressor 3 is referred to as the suction pipe 11. Thus, during both a cooling operation (operation that supplies low-temperature low-pressure refrigerant to the indoor heat exchanger 7) and a heating operation (operation that supplies high-temperature high-pressure refrigerant to the indoor heat exchanger 7), high-temperature high-pressure gaseous refrigerant compressed by the compressor 3 always flows in the discharge pipe 12, and low-temperature low-pressure refrigerant after an evaporation action flows in the suction pipe 11.

The low-temperature low-pressure refrigerant flowing in the suction pipe 11 is sometimes gaseous refrigerant and sometimes in a two-phase state. A service port 14*a* with a flare joint attached thereto at the low-pressure side is disposed in the suction pipe 11, and a service port 14*c* with a flare joint attached thereto at the high-pressure side is disposed in the discharge pipe 12. On installation or a test operation at the time of repair, pressure gauges are connected to the service ports 14*a* and 14*c* so that the service ports 14*a* and 14*c* are used to measure the operating pressure.

Note that an external thread is made on each of the flare joints (not illustrated) of the service ports 14*a* and 14*c*. A flare nut (not illustrated) is attached on the external thread, at the time of shipment of the outdoor unit 102 (including the time of shipment of the air-conditioning apparatus 100).

(Refrigerant Circuit of Indoor Unit)

The indoor unit 101 includes an indoor heat exchanger 7 as a use-side heat exchanger that exchanges heat between the indoor air and the refrigerant. Indoor pipes (i.e., use-side refrigerant pipes) 9*a* and 9*b* are connected to the indoor heat exchanger 7 (the configuration of the indoor pipes 9*a* and 9*b* will be described separately in detail).

A flare joint 15*a* for connection to the gas-side extension pipe 10*a* is disposed on the indoor pipe 9*a* at the connection portion to the gas-side extension pipe 10*a*. On the other hand, a flare joint 15*b* for connection to the liquid-side extension pipe 10*b* is disposed on the indoor pipe 9*b* at the connection portion to the liquid-side extension pipe 10*b*.

An external thread is made on each of the flare joints 15*a* and 15*b*. A flare nut (not illustrated) having an internal thread processed therein that engages the external thread is attached thereon, at the time of shipment of the indoor unit 101 (including the time of shipment of the air-conditioning apparatus 100).

Further, an indoor fan 7*f* is disposed to face the indoor heat exchanger 7, and generates an air flow that passes through the indoor heat exchanger 7 by rotation of the indoor fan 7*f*. Note that the indoor fan 7*f* is driven by a non-brush motor (an induction motor or a DC brushless motor), and therefore does not generate sparks that may become the ignition source during operation. Further, various types of fans such as a cross-flow fan, a turbo fan may be used as the indoor fan 7*f*, depending on the form of the indoor unit 101. Further, the position of the indoor fan 7*f* may be either the downstream or the upstream of the indoor heat exchanger 7 in the air flow generated by the indoor fan 7*f*.

(Refrigerant Circuit of Air Conditioning Apparatus)

The gas-side extension pipe 10*a* has one end detachably connected to the flare joint 16*a* attached to the gas-side extension pipe connecting valve 13*a* of the outdoor unit 102, and has the other end detachably connected to the flare joint 15*a* attached to the indoor pipe 9*a* of the indoor unit 101. On the other hand, the liquid-side extension pipe 10*b* has one end detachably connected to the flare joint 16*b* attached to the liquid-side extension pipe connecting valve 13*b* of the outdoor unit 102, and has the other end detachably connected to the flare joint 15*b* attached to the indoor pipe 9*b* of the indoor unit 101.

That is, the outdoor pipe 8 is connected to the indoor pipes 9*a* and 9*b* by the extension pipes 10*a* and 10*b* so that a refrigerant circuit is formed, and a compression heat pump cycle that circulates the refrigerant compressed by the compressor 3 is formed.

(Flow of Refrigerant During Cooling Operation)

In FIG. 1, the solid arrows indicate the flow direction of refrigerant during a cooling operation. In a cooling operation, the four-way valve 4 is switched to form a refrigerant circuit indicated by the solid lines. Thus, high-temperature high-pressure gas refrigerant discharged from the compressor 3 first flows into the outdoor heat exchanger 5 via the four-way valve 4.

The outdoor heat exchanger 5 functions as a condenser. That is, when an air flow generated by rotation of the outdoor fan 5*f* passes through the outdoor heat exchanger 5, the outdoor air passing therethrough and the refrigerant flowing in the outdoor heat exchanger 5 exchange heat, so that condensation heat of the refrigerant is applied to the outdoor air. Thus, the refrigerant is condensed to become liquid refrigerant in the outdoor heat exchanger 5.

Then, the liquid refrigerant flows into the expansion valve 6. In the expansion valve 6, the liquid refrigerant is adiabatically expanded to become low-pressure low-temperature two-phase refrigerant.

Subsequently, the low-pressure low-temperature two-phase refrigerant is supplied to the indoor unit 101 through the extension pipe 10*b* and the indoor pipe 9*b* at the liquid side, and flows into the indoor heat exchanger 7. This indoor heat exchanger 7 functions as an evaporator. That is, when the flow of indoor air generated by rotation of the indoor fan 7*f* passes through the indoor heat exchanger 7, the indoor air passing therethrough and the refrigerant flowing in the indoor heat exchanger 7 exchange heat. Thus, the refrigerant evaporates to turn into low-temperature low-pressure gaseous refrigerant or two-phase refrigerant, by taking evaporation heat (heating energy) from the indoor air. On the other hand, the indoor air passing therethrough is cooled by taking cooling energy from the refrigerant, and cools the room.

Further, the refrigerant that has evaporated to turn into of low-temperature low-pressure gaseous refrigerant or two-phase refrigerant in the indoor heat exchanger 7 is supplied to the outdoor unit 102 through the indoor pipe 9*a* and the extension pipe 10*a* at the gas side, and is suctioned into the compressor 3 via the four-way valve 4. Then, the refrigerant is again compressed to turn into high-temperature high-pressure gaseous refrigerant in the compressor 3. This cycle is repeated during the cooling operation.

(Flow of Refrigerant During Heating Operation)

In FIG. 1, the dotted arrows indicate the flow direction of refrigerant during a heating operation. When the four-way valve 4 is switched to form a refrigerant circuit indicated by the dotted lines, the refrigerant flows in a direction opposite to that during a cooling operation. Thus, the refrigerant first flows into the indoor heat exchanger 7. The indoor heat exchanger 7 functions as a condenser, and the outdoor heat exchanger 5 functions as an evaporator. Thus, condensation heat (heating energy) is applied to heat the indoor air passing through the indoor heat exchanger 7, thereby performing a heating operation.

(Refrigerant)

In the air-conditioning apparatus 100, R32 ($CH_2F_2$; difluoromethane) is used as a refrigerant flowing in the refrigerant circuit. R32 is an HFC refrigerant that has a lower GWP than R410A, which is the HFC refrigerant that is currently and commonly used in air conditioning apparatuses. R32 has a relatively low impact on global warming, but is slightly flammable. The outdoor unit 102 is shipped with a certain amount of refrigerant sealed therein in advance. On installing the air-conditioning apparatus 100, if refrigerant is not enough for the length of the extension pipes 10*a* and 10*b*, refrigerant is added on site. Alternatively, the outdoor unit 102 may be shipped with no refrigerant sealed therein, and the full amount of refrigerant may be charged (sealed) on site.

Note that the refrigerant is not limited to R32, and may be any of the above described HFO refrigerants, such as HFO-1234yf ($CF_3CF{=}CH_2$; tetrafluoropropene) and HFO-1234ze ($CF_3{-}CH{=}CHF$), which are slightly flammable, similar to R32; which are halogenated hydrocarbons that are a type of HFC refrigerant but have a carbon double bond in their composition; and which have a lower GWP than R32.

Further, the refrigerant may be a highly flammable HC refrigerant such as R290 ($C_3H_8$; propane) and R1270 ($C_3H_6$; propylene). Further, the refrigerant may be a mixed refrigerant as a mixture of two or more of these refrigerants.

(Configuration of Indoor Unit)

In FIG. 2, the indoor unit 101 includes the indoor heat exchanger 7 and the indoor fan 7*f* (see FIG. 1) that are accommodated in a housing 110. The housing 110 includes a housing front surface 111, a housing top surface 114, a housing rear surface 115, and a housing bottom surface 116. An air inlet 112 is formed at the lower part of the housing front surface 111, and an air outlet 113 is formed at the upper part of the housing front surface 111. Further, an operation display unit 2 is disposed on the housing front surface 111. The operation display unit 2 is used for operations such as starting and stopping the air-conditioning apparatus 100, switching between cooling and heating, and changing the air volume of the indoor fan 7*f*. Further, the operation display unit 2 displays the operational status and other related contents.

Note that the size and shape of the air inlet 112 and the air outlet 113 are not limited to those illustrated in FIG. 2. For example, the air outlet 113 may be formed to extend from the upper part of the housing front surface 111 to the housing top surface 114. Further, the conditioned air is cool air during a cooling operation, warm air during a heating operation, and dry air during a drying operation.

In FIGS. 3 and 4, the inside of the housing 110 is divided into upper and lower spaces by a partition plate 20 with a communication opening 21 formed therein. In the lower space, the indoor fan 7*f* is disposed at a position facing the air inlet 112, in the vicinity of the housing rear surface 115.

The indoor heat exchanger 7 is inclined in the upper space so that the upper end is located close to the housing rear surface 115 and the lower end is located close to the housing front surface 111. The communication opening 21 of the partition plate 20 is located within a range where the indoor heat exchanger 7 is projected vertically downward.

That is, the indoor fan 7*f* suctions the indoor air in the lower space from the air inlet 112, and supplies the indoor air to the indoor heat exchanger 7 in the upper space through the communication opening 21. Then, the indoor air having exchanged heat in the indoor heat exchanger 7 becomes "conditioned air" and is blown into the room through the air outlet 113.

Note that, as mentioned above, the indoor fan 7*f* is driven by a non-brush motor (an induction motor or a DC brushless motor), and therefore does not generate sparks that may become the ignition source during operation.

(Connection Between Indoor Exchanger and Indoor Pipe)

Figure 5:
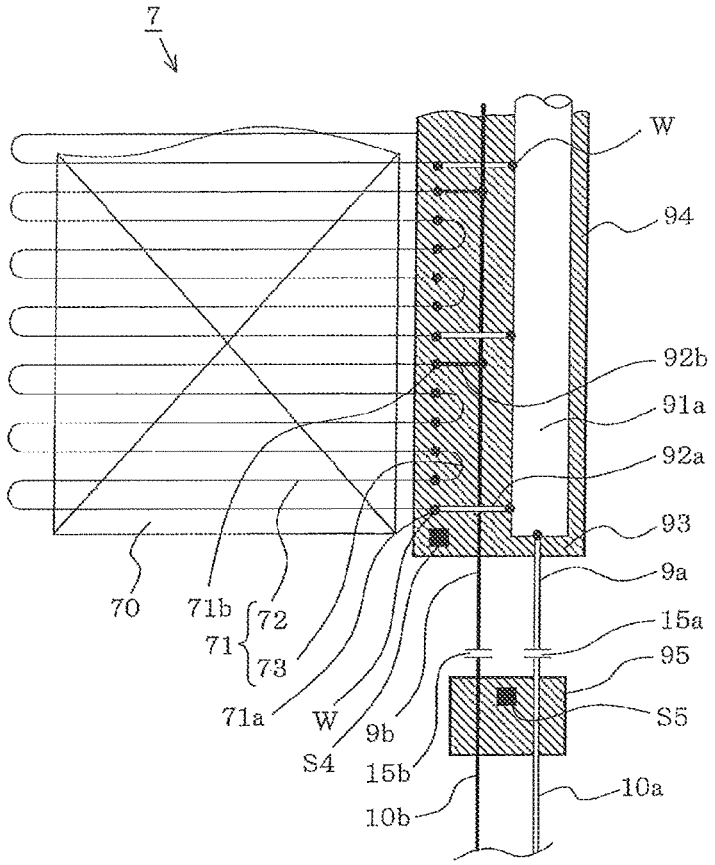
FIG. 5 is an enlarged partial front view schematically illustrating the connection between an indoor heat exchanger and an indoor pipe in the indoor unit of FIG. 2.

FIG. 5 is a diagram for explaining the air-conditioning apparatus according to Embodiment 1 of the present invention, and is an enlarged partial front view schematically illustrating the connection between the indoor heat exchanger and the indoor pipe. Note that the drawings are schematic, and the present invention is not limited to the embodiment illustrated in the drawings.

In FIG. 5, the indoor heat exchanger 7 includes a plurality of radiator plates (i.e., fins) 70 disposed to be spaced apart from each other, and a plurality of heat-transfer pipes 71 extending through the radiator plates 70.

Each of the heat-transfer pipes 71 includes a plurality of U-shaped pipes (hereinafter referred to as "hairpins") 72 each having long straight pipe portions, and arc-shaped U-bends 73 each having short straight pipe portions allowing communications between the plurality of hairpins 72. The hairpins 72 and the U-bends 73 are connected to each other at connection portions (hereinafter referred to as "brazed portions W", and indicated by black circles in FIG. 5). Note that the number of heat-transfer pipes 71 is not limited, and there may be one or a plurality of heat-transfer pipes 71. Also, the number of hairpins 72 included in each of the heat-transfer pipes 71 is not limited.

The gas-side indoor pipe 9*a* is connected to a cylindrical header main pipe 91*a*. The header main pipe 91*a* is connected to a plurality of header branch pipes 92*a*. The header branch pipes 92*a* are connected to first ends 71*a* of the heat-transfer pipes 71 (i.e., the hairpins 72).

Further, the liquid-side (two-phase-side) indoor pipe 9*b* is connected to a plurality of indoor refrigerant branch pipes 92*b* to be divided into a plurality of branches. Further, the header branch pipes 92*a* are connected to second ends 71*b* of the heat-transfer pipes 71 (i.e., the hairpins 72).

The connection between the header main pipe 91*a* and the header branch pipes 92*a*, the connection between the header branch pipes 92*a* and the ends 71*a*, the connection between the indoor pipe 9*b* and the indoor refrigerant branch pipes 92*b*, and the connection between the indoor refrigerant branch pipes 92*b* and the ends 71*b* are all made at brazed portions W (indicated by black circles in FIG. 5). Note that in the above description, the brazed portions W are illustrated as the connection portions. However, the present invention is not limited thereto, and any connecting units may be used.

(First Leaked Refrigerant Receiver)

In FIGS. 3 to 5, a first leaked refrigerant receiver 94 (indicated by the hatched lines) is disposed to face the header main pipe 91*a* and other components, to be parallel to the header main pipe 91*a* and other components, and to be located vertically below the header main pipe 91*a* and other components.

The first leaked refrigerant receiver 94 is a gutter covering the area vertically below the brazed portions W, and a first leaked refrigerant storing part 93 is formed at the lower end thereof. Thus, when the refrigerant (that has a higher specific gravity than the indoor air) leaks from the positions of the brazed portions W, the first leaked refrigerant receiver 94 receives the leaked refrigerant and causes the leaked refrigerant to flow into the first leaked refrigerant storing part 93.

Note that the shape of the first leaked refrigerant receiver 94 is not particularly limited. The first leaked refrigerant receiver 94 may be a relatively deep receiver having a rectangular cross section or an arcuate cross section, and having a notch or a through hole through which the hairpins 72 extend, or may be a relatively shallow receiver having a side edge that is in contact with or is in close proximity to the lower surfaces of the hairpins 72.

The first leaked refrigerant storing part 93 is designed to temporarily store the refrigerant having flowed therein along the first leaked refrigerant receiver 94, and the storage capacity is not limited. Thus, the lower end of the first leaked refrigerant receiver 94 may be closed, and thus the area close to the lower end of the first leaked refrigerant receiver 94 may be regarded as the first leaked refrigerant storing part 93, without especially providing the first leaked refrigerant storing part 93.

Note that although the indoor pipe 9*a* and the indoor pipe 9*b* extend through the first leaked refrigerant storing part 93, the indoor pipe 9*a* and the indoor pipe 9*b* may be bent to extend around the first leaked refrigerant storing part 93 so that the indoor pipe 9*a* and the indoor pipe 9*b* do not extend through the first leaked refrigerant storing part 93.

(Second Leaked Refrigerant Receiver)

A second leaked refrigerant receiver 95 is disposed vertically below the flare joint 15*a* and the flare joint 15*b*. The second leaked refrigerant receiver 95 is a box covering a certain area vertically below the flare joint 15*a* and the flare joint 15*b*. When the refrigerant (that has a higher specific gravity than the indoor air) leaks from the flare joint 15*a* or the flare joint 15*b*, the second leaked refrigerant receiver 95 receives the leaked refrigerant and stores a certain amount of the leaked refrigerant.

Note that although the extension pipe 10*a* and the extension pipe 10*b* extend through the second leaked refrigerant receiver 95, the extension pipe 10*a* and the extension pipe 10*b* may be bent to extend around the second leaked refrigerant receiver 95 so that the extension pipe 10*a* and the extension pipe 10*b* do not extend through the second leaked refrigerant receiver 95.

(Temperature Sensor)

A temperature sensor (hereinafter referred to as an "inlet temperature sensor") S1 that measures the temperature of the inlet air (i.e., the indoor air) during operation is disposed at the suction side (between the air inlet 112 and the indoor fan 7*f*) of the indoor fan 7*f*.

Further, a temperature sensor (hereinafter referred to as a "liquid pipe sensor") S2 and a temperature sensor (hereinafter referred to as a "two-phase pipe sensor") S3 are disposed in the indoor heat exchanger 7. The liquid pipe sensor S2 measures the temperature of the refrigerant flowing into the indoor heat exchanger 7 during a cooling operation, and measures the temperature of the refrigerant flowing out of the indoor heat exchanger 7 during a heating operation. The two-phase pipe sensor S3 is located at the substantial center of the indoor heat exchanger 7, and measures the evaporating temperature or the condensing temperature of the refrigerant.

Then, each of the temperatures detected by the inlet temperature sensor S1, the liquid pipe sensor S2, and the two-phase pipe sensor S3 is input to the control unit 1, and is used for controlling the operations of the compressor 3 and other related functions.

Further, a temperature sensor (hereinafter referred to as a "first temperature sensor") S4 is disposed in the first leaked refrigerant receiver 94 (more precisely, the first leaked refrigerant storing part 93), and a temperature sensor (hereinafter referred to as a "second temperature sensor") S5 is disposed in the second leaked refrigerant receiver 95.

That is, because the refrigerant may leak from the connection portions formed by the brazed portions W due to aging or an external force such as earthquake, if the refrigerant leaks, the first leaked refrigerant receiver 94 receives the leaked refrigerant having a higher specific gravity than the indoor air, and the first temperature sensor S4 detects a reduction in temperature of the atmosphere that is cooled by heat removal due to the vaporization heat of the leaked refrigerant.

Since the first leaked refrigerant storing part 93 that stores a certain amount of leaked refrigerant is provided and the first temperature sensor S4 is provided therein, it is possible to detect a reduction in temperature of the atmosphere temperature (ambient air) due to the vaporization heat of the leaked refrigerant at an early stage, and thus to detect refrigerant leakage early and reliably.

Note that in the present invention, it suffices to provide the first temperature sensor S4 at the upper side of the partition plate 20, without providing the first leaked refrigerant receiver 94. That is, the leaked refrigerant falls from a pinhole or another related component, and remains on the partition plate 20 in the case where the first leaked refrigerant receiver 94 is not provided. Therefore, by installing the first temperature sensor S4 at a position close to the partition plate 20, it is possible to detect a reduction in temperature of the ambient air due to the vaporization heat of refrigerant leakage.

Further, the refrigerant may also leak from the connection portions formed by the flare joints 15*a* and 15*b* due to aging or an external force such as earthquake. Therefore, by providing the second leaked refrigerant receiver 95 that receives and stores the refrigerant (that has a higher specific gravity than the indoor air) leaked from the flare joint 15*a* or the flare joint 15*b*, and by providing the second temperature sensor S5 therein, it is possible to detect refrigerant leakage early and reliably.

Note that since the refrigerant (that has a higher specific gravity than the indoor air) leaked from the flare joint 15*a* or the flare joint 15*b* falls and remains on the housing bottom surface 116 of the housing 110, the second temperature sensor S5 may be installed at a position close to the housing bottom surface 116, without providing the second leaked refrigerant receiver 95.

Further, since the temperature of the air in the area below the partition plate 20 in the housing 110 reduces due to vaporization of the refrigerant (that has a higher specific gravity than the indoor air) leaked from the flare joint 15*a* or the flare joint 15*b*, the second leaked refrigerant receiver 95 and the second temperature sensor S5 may be removed, a temperature detection by the inlet temperature sensor S1 may be performed while the operation is performed and while the operation is stopped, and the function of the second temperature sensor S5 may be added to the inlet temperature sensor S1 (i.e., the function of the inlet temperature sensor S1 is added to the second temperature sensor S5).

Figure 6A:
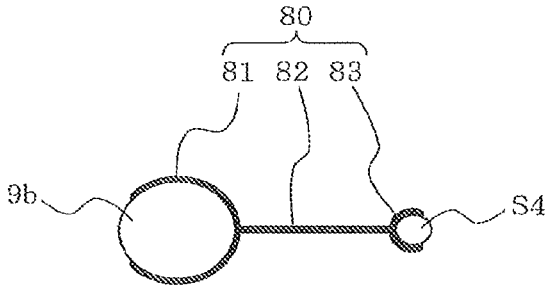
FIG. 6A is a cross-sectional plan view illustrating an example of the installation form of a temperature sensor in the indoor unit of FIG. 2.
Figure 6B:
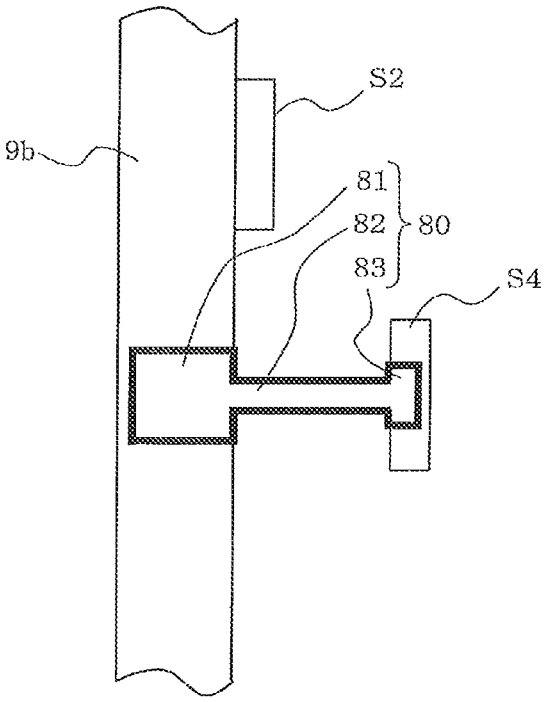
FIG. 6B is a front view illustrating the example of the installation form of a temperature sensor in the indoor unit of FIG. 2.

FIGS. 6A and 6B are diagrams for explaining the air-conditioning apparatus according to Embodiment 1 of the present invention, and illustrate an example of the installation form of the temperature sensors. FIG. 6A is a cross-sectional plan view, and FIG. 6B is a front view.

In FIGS. 6A and 6B, the first temperature sensor S4 is disposed on the indoor pipe 9*b* with a holder 80 therebetween. The holder 80 has a lower thermal conduction performance. That is, the holder 80 includes a pipe holding part 81 that has a C-shaped cross section and holds the indoor pipe 9*b*, a sensor holding part 83 that has a C-shaped cross section and holds the first temperature sensor S4, and an arm part 82 that connects the pipe holding part 81 to the sensor holding part 83. The holder 80 is made by a material with a low thermal conductivity such as, synthetic resin, and the cross-sectional area of the arm part 82 is small. Note that in place of the pipe holding part 81 that has a C-shaped cross section and holds the indoor pipe 9*b*, a part that has a U-shaped cross section and holds the first leaked refrigerant storing part 93, or a flat or curved part that is disposed in the first leaked refrigerant storing part 93 may be provided.

In FIG. 6B, the liquid pipe sensor S2 is disposed directly on the outer surface of the indoor pipe 9*b*, and directly detects the outer surface temperature of the indoor pipe 9*b*.

(Control of Refrigeration Cycle)

The control unit 1 controls the refrigeration cycle (the compressor 3, the expansion valve 6, and other components) on the basis of the values detected by the inlet temperature sensor S1, the liquid pipe sensor S2, and the two-phase pipe sensor S3.

Note that the positions where the liquid pipe sensor S2 and the two-phase pipe sensor S3 are not limited to the positions illustrated in the drawings.

Embodiment 2

Figure 7:
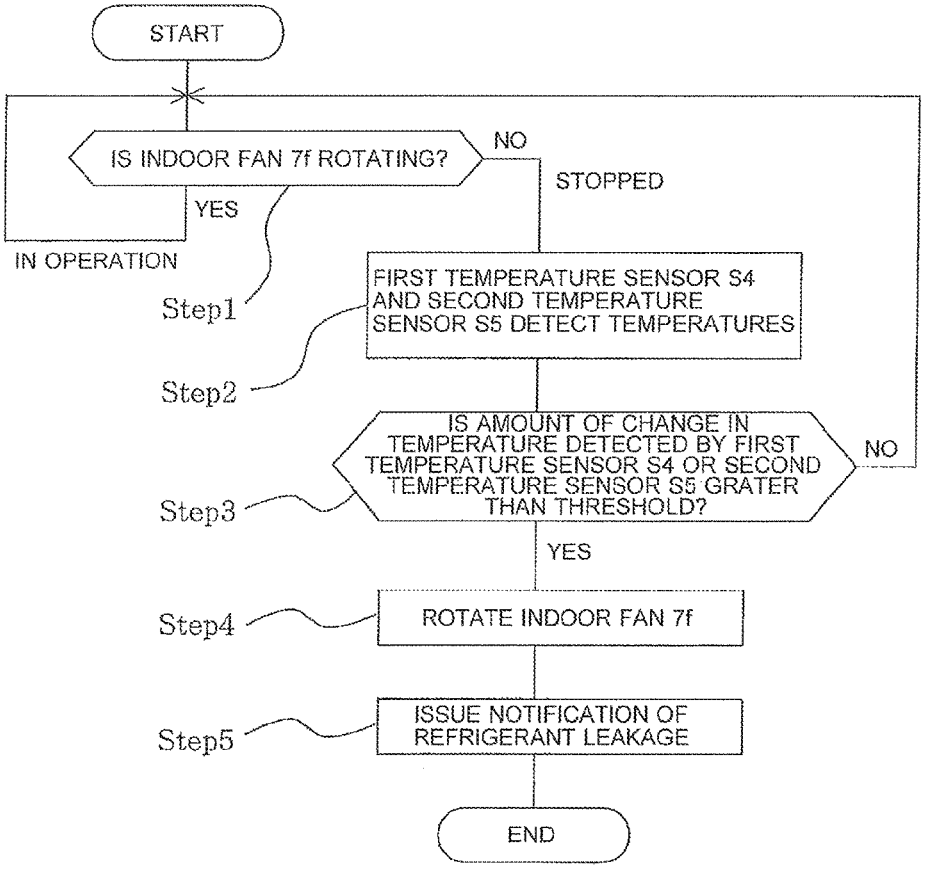
FIG. 7 is a flowchart for explaining a refrigerant leakage detection method according to Embodiment 2 of the present invention.

FIG. 7 is a flowchart for explaining a refrigerant leakage detection method according to Embodiment 2 of the present invention.

In FIG. 7, the refrigerant leakage detection method is a method that detects leakage of the refrigerant in the air-conditioning apparatus 100 (Embodiment 1). Note that that the elements identical or equivalent to those in Embodiment 1 are denoted by the same reference signs, and a description thereof will be partially omitted.

In the case where the refrigerant leaks while the air-conditioning apparatus 100 is in operation (while the indoor fan 7*f* is rotating), since the air in the room is stirred by the conditioned air that is blown out, an area with a high concentration of leaked refrigerant is not formed in the room (not illustrated). On the other hand, in the case where the refrigerant leaks while the air-conditioning apparatus 100 is stopped (while the indoor fan 7*f* is not rotating), an area with a high concentration of leaked refrigerant is likely to be formed in the room.

Thus, in the air-conditioning apparatus 100, only while the operation is stopped (while the indoor fan 7*f* is not rotating) (Step 1), the first temperature sensor S4 and the second temperature sensor S5 detect temperatures (Step 2). Then, the first temperature sensor S4 and the second temperature sensor S5 detect temperatures at certain time intervals. If, in even one of the first temperature sensor S4 and the second temperature sensor S5, the amount of change in the detected temperature is greater than a certain threshold (for example, the difference between the previous detection value and the current detection value is 5 degrees C.) or the rate of change in the detected temperature is greater than a certain threshold (for example, 5 degrees C./minute) when the detected temperature decreases, the control unit 1 determines that the refrigerant is leaking (Step 3).

(Operation after Detection of Refrigerant Leakage)

When the refrigerant is determined to be leaking while the operation is stopped, the control unit 1 of the air-conditioning apparatus 100 starts rotation of the indoor fan 7*f* to stir the air in the room (Step 4).

Further, a notifying unit (the operation display unit 2, a non-illustrated sound generating unit, or another related component) disposed in the main body of the indoor unit 101 issues a notification such as "Refrigerant is leaking, please open the window" (Step 5).

Note that execution of Step 5 may be omitted.

(Advantageous Effects)

Figure 8:
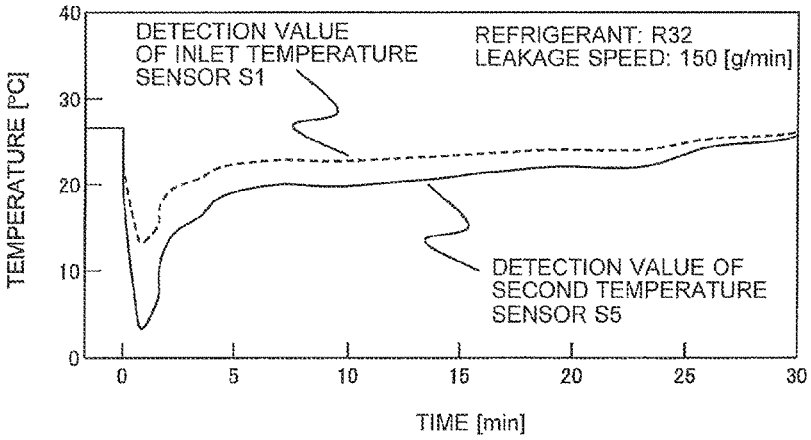
FIG. 8 illustrates the experimental results representing the temperature detection characteristics for explaining the refrigerant leakage detection method according to Embodiment 2 of the present invention.

FIG. 8 illustrates the experimental results representing the temperature detection characteristics for explaining the refrigerant leakage detection method according to Embodiment 2 of the present invention. That is, in FIG. 8, the vertical axis represents the temperatures (degrees C.) detected by the second temperature sensor S5 and the inlet temperature sensor S1 when a refrigerant R32 leaks from the flare joint 15*a* at a leakage speed of 150 g per minute in the air-conditioning apparatus 100, and the horizontal axis represents the time (minute) from the start of the leakage.

That is, the refrigerant leaked from the flare joint 15*a* rapidly adiabatically expands. Thus, while the refrigerant is taking the heating energy from the surroundings, the refrigerant falls due to its specific gravity being higher than that of the indoor air and flows into the second leaked refrigerant receiver 95. Thus, the ambient temperature, especially the atmosphere temperature of the second leaked refrigerant receiver 95, decreases rapidly, and therefore the temperature detected by the second temperature sensor S5 decreases rapidly immediately after the start of the leakage.

Meanwhile, the temperature detected by the inlet temperature sensor S1 also decreases rapidly immediately after the start of the leakage, although not as greatly as that detected by the second temperature sensor S5. This is because the temperature in the lower area of the housing 110 is reduced due to adiabatic expansion of the leaked refrigerant that does not yet flow into the second leaked refrigerant receiver 95 or adiabatic expansion of the leaked refrigerant that did not flow into the second leaked refrigerant receiver 95.

As is obvious from the experimental results described above, the refrigerant leakage detection method used in the air-conditioning apparatus 100 has the following remarkable advantageous effects.

(i) The atmosphere temperature (the refrigerant temperature or the air temperature) at a position where refrigerant leakage may occur is directly detected, and a determination is made that the refrigerant is leaking, on the basis of the state of change (reduction) in the detected temperature. Therefore, it is possible to make a determination accurately and quickly.

(ii) That is, no influence is exerted by the state of distribution of the refrigerant in the refrigerant circuit while the operation is stopped, or by the state of movement of the refrigerant in the refrigerant circuit after occurrence of refrigerant leakage, and therefore the problems with the split type air-conditioning apparatus disclosed in Patent Literature 1 are solved.

(iii) Further, since the atmosphere temperature directly cooled by heat removal associated with evaporation of the leaked refrigerant is detected, the detection sensitivity is not reduced due to the heat capacity (heat inertia) of the members such as pipes.

(iv) Further, since the first leaked refrigerant receiver 94 and the second leaked refrigerant receiver 95 are provided, the leaked refrigerant (in some cases, the air cooled by heat removal due to adiabatic expansion of the leaked refrigerant is included) reaches the areas around the first temperature sensor S4 and the second temperature sensor S5 more certainly.

(v) Note that in the case where the second temperature sensor S5 is removed and the inlet temperature sensor S1 is used to detect refrigerant leakage, the number of components is reduced, and the production cost is reduced.

(vi) Further, in the case where a determination is made that the refrigerant is leaking while the operation is stopped, rotation of the indoor fan 7*f* is started to stir the air in the room. Therefore, it is possible to reduce formation of an area with a high concentration of leaked refrigerant in the room. Further, since the notifying unit issues a notification of the leakage of the refrigerant to prompt the user to give ventilation or take other measures, it is possible to reduce formation of an area with a high concentration of leaked refrigerant in the room.

Note that in the above description, although the first leaked refrigerant receiver 94 and the second leaked refrigerant receiver 95 are provided, and the first temperature sensor S4 and the second temperature sensor S5 are disposed therein, respectively, the present invention is not limited thereto. For example, an opening communicating with the second leaked refrigerant receiver 95 may be formed in each of the first leaked refrigerant receiver 94 and the partition plate 20, and thus the provision of the first temperature sensor S4 may be omitted. In this case, by placing the second leaked refrigerant receiver 95 so that the upper edge thereof is in contact with or close to the partition plate 20, the flow of the leaked refrigerant into the area around the second temperature sensor S5 is further promoted.

Embodiment 3

Figure 9:
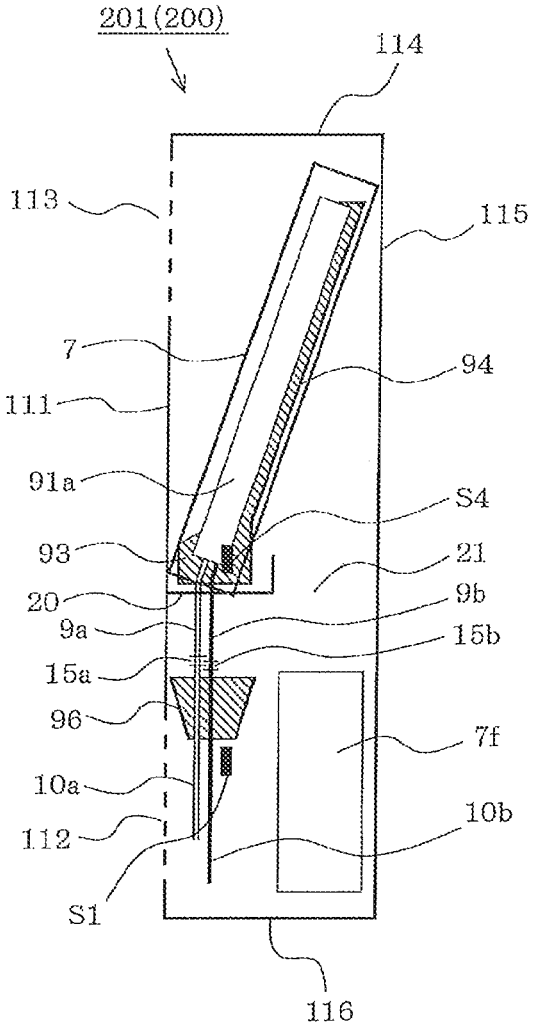
FIG. 9 is a diagram for explaining an air-conditioning apparatus according to Embodiment 3 of the present invention, and is a schematic partially transparent side view of an indoor unit.

FIG. 9 is a diagram for explaining an air-conditioning apparatus according to Embodiment 3 of the present invention, and is a schematic partially transparent side view of an indoor unit. Note that that the elements identical or equivalent to those in Embodiment 1 are denoted by the same reference signs, and a description thereof will be partially omitted.

In FIG. 9, a third leaked refrigerant receiver 96 of an indoor unit 201 included in an air-conditioning apparatus 200 has a funnel shape, and has the shape of an inverted truncated cone with no bottom. Further, an inlet temperature sensor S1 is disposed under the third leaked refrigerant receiver 96. Unlike Embodiment 1, a second temperature sensor S5 is not provided in the third leaked refrigerant receiver 96. Except these points, the air-conditioning apparatus 200 is the same as the air-conditioning apparatus 100 (Embodiment 1).

That is, when the refrigerant (that has a higher specific gravity than the indoor air) leaks from a flare joint 15*a* or a flare joint 15*b*, the refrigerant is guided by the third leaked refrigerant receiver 96 to flow into the area around the inlet temperature sensor S1. Thus, leakage of the refrigerant is determined on the basis of changes in the temperature detected by the inlet temperature sensor S1 that continuously performs temperature detection even while the operation is stopped. That is, a refrigerant leakage detection method used in the air-conditioning apparatus 200 is in accordance with Embodiment 2, and the second temperature sensor S5 in Embodiment 2 corresponds to the inlet temperature sensor S1.

Therefore, since the second temperature sensor S5 is not provided and thus the number of components is reduced, the production cost of the air-conditioning apparatus 200 is reduced.

Note that in the above description, although the first temperature sensor S4 is disposed in the first leaked refrigerant receiver 94, the present invention is not limited thereto. For example, an opening communicating with the third leaked refrigerant receiver 96 may be formed in each of a first leaked refrigerant receiver 94 and a partition plate 20, and thus the provision of the first temperature sensor S4 may be omitted (in this case, by placing the third leaked refrigerant receiver 96 so that the upper edge thereof is in contact with or close to the partition plate 20, the flow of the leaked refrigerant into the area around the inlet temperature sensor S1 is further promoted).

Embodiment 4

Figure 10A:
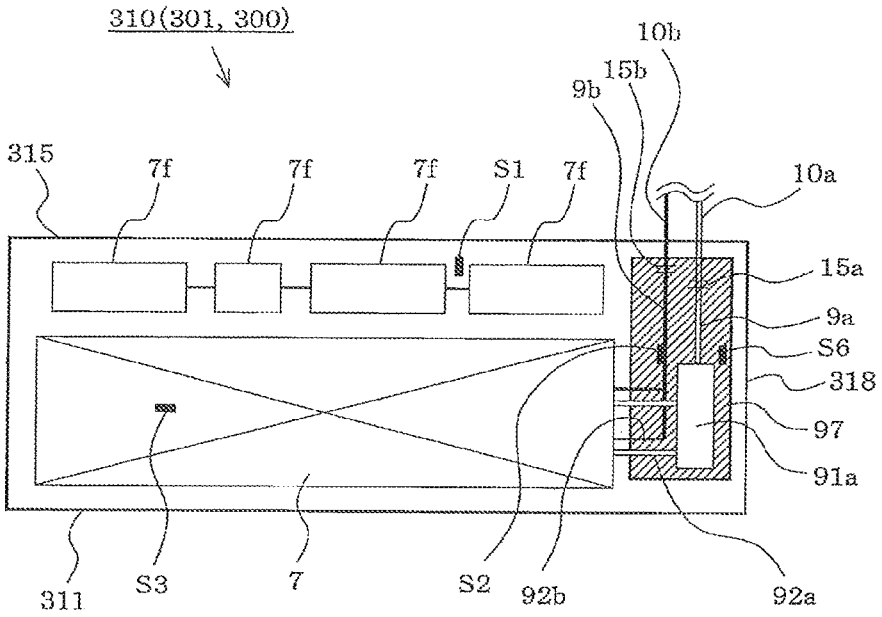
FIG. 10A is a diagram for explaining an air-conditioning apparatus according to Embodiment 4 of the present invention, and is a schematic partially transparent top view of an indoor unit.
Figure 10B:
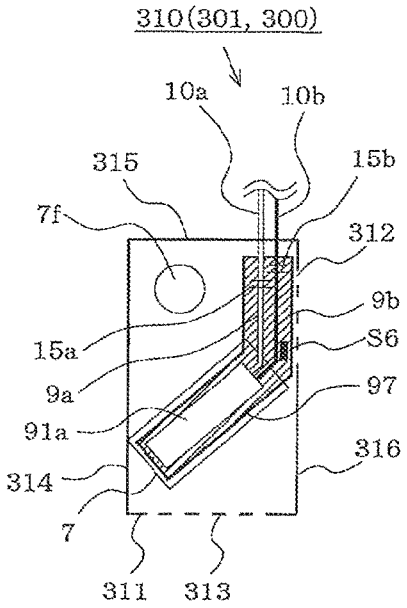
FIG. 10B is a diagram for explaining the air-conditioning apparatus according to Embodiment 4 of the present invention, and is a schematic partially transparent side view of the indoor unit.

FIGS. 10A and 10B are diagrams for explaining an air-conditioning apparatus according to Embodiment 4 of the present invention. FIG. 10A is a schematic partially transparent top view of an indoor unit, and FIG. 10B is a schematic partially transparent side view of the indoor unit. Note that that the elements identical or equivalent to those in Embodiment 1 are denoted by the same reference signs, and a description thereof will be partially omitted.

In FIGS. 10A and 10B, an indoor unit 301 of an air-conditioning apparatus 300 is a ceiling suspended unit that is mounted to be suspended from the ceiling (not illustrated) of the room, and includes a housing 310 accommodating therein an indoor heat exchanger 7 and an indoor fan 7*f*.

Further, an air inlet 312 is formed in a housing bottom surface 316 of the housing 310 close to a housing rear surface 315, and an air outlet 313 is provided in a housing front surface 311.

The indoor fan 7*f* is located at a position close to the housing rear surface 315. The indoor heat exchanger 7 is disposed to be inclined toward the corner between the housing front surface 311 and the housing top surface 314.

Note that indoor pipes 9*a* and 9*b* are connected to the indoor heat exchanger 7 in a position close to a housing right end surface 318. These connections are made in the same manner as in Embodiment 1 (brazed portions W, see FIG. 5), and therefore the description thereof will be omitted.

Further, a fourth leaked refrigerant receiver 97 is formed that covers the area vertically below the connection portions (the brazed portions W, see FIG. 5) between the indoor heat exchanger 7 and the indoor pipes 9*a* and 9*b* and the area vertically below a flare joint 15*a* and a flare joint 15*b* (imaginary lines formed by projecting vertically downward the positions of all the brazed portions W and the positions of the flare joints 15*a* and 15*b* intersect the fourth leaked refrigerant receiver 97). The fourth leaked refrigerant receiver 97 has a U-shaped cross section (including those that are wider at the opening side than at the bottom side) or an arcuate cross section, and is a gutter with an open upper end and a closed lower end.

Further, a temperature sensor (hereinafter referred to as a "third temperature sensor") S6 is disposed at a position close to the lower end of the fourth leaked refrigerant receiver 97.

That is, if the refrigerant leaks from any of the positions of the brazed portions W or from the flare joint 15*a* or the flare joint 15*b*, the leaked refrigerant is received by the fourth leaked refrigerant receiver 97, and the atmosphere temperature around the third temperature sensor S6 changes rapidly. Further, a refrigerant leakage detection method used in the air-conditioning apparatus 300 is in accordance with Embodiment 2, and the first temperature sensor S4 and the second temperature sensor S5 in Embodiment 2 correspond to the third temperature sensor S6.

Thus, similarly to Embodiment 1 and Embodiment 2, it is possible to detect refrigerant leakage early.

Note that the location of the connection portions (the brazed portions W) between the indoor heat exchanger 7 and the indoor pipes 9*a* and 9*b* and the location of the flare joints 15*a* and 15*b* are away from each other (away from each other in the horizontal direction), a leaked refrigerant receiver and a temperature sensor may be provided in each of the locations.

Embodiment 5

Figure 11A:
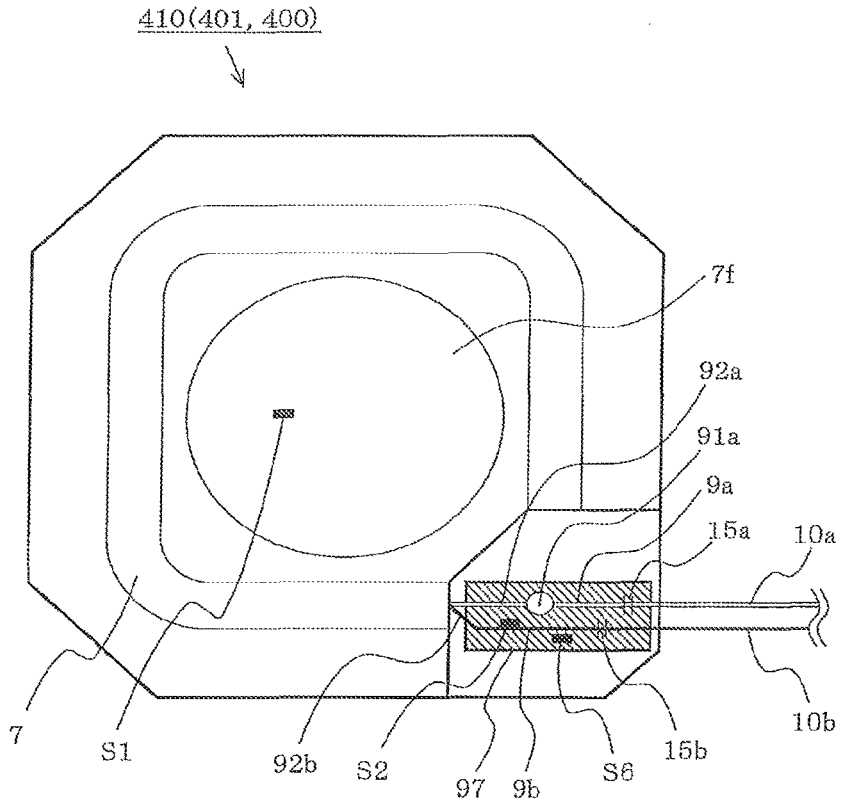
FIG. 11A is a bottom plan view for explaining an air-conditioning apparatus according to Embodiment 5 of the present invention.
Figure 11B:
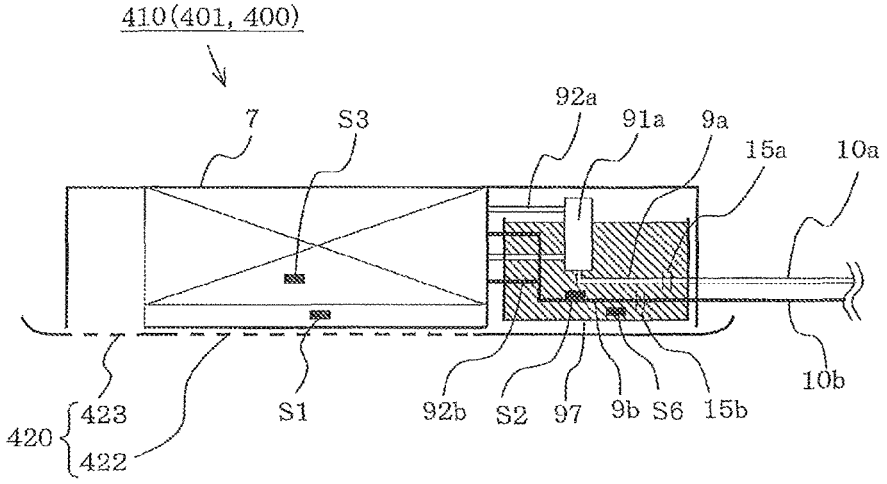
FIG. 11B is a cross-sectional side view for explaining the air-conditioning apparatus according to Embodiment 5 of the present invention.

FIGS. 11A and 11B are diagrams for explaining an air-conditioning apparatus according to Embodiment 5 of the present invention. FIG. 11A is a bottom plan view, and FIG. 11B is a cross-sectional side view. Note that that the elements identical or equivalent to those in Embodiment 3 are denoted by the same reference signs, and a description thereof will be partially omitted.

In FIGS. 11A and 11B, an indoor unit 401 of an air-conditioning apparatus 400 is a ceiling embedded unit that is mounted to be embedded in the ceiling (not illustrated) of the room, and includes a housing 410 accommodating therein an indoor heat exchanger 7 and an indoor fan 7*f*.

The housing 410 is a box having a square cross section with chamfered corners, and a decorative grille 420 is detachably attached to a housing bottom surface 416. In the decorative grille 420, an air inlet 422 formed at the center, and air outlets 423 are formed at four positions around the air inlet 422. Further, the indoor fan 7*f* is installed at the center of the housing top surface 414, and an indoor heat exchanger 7 having a square ring shape is disposed to surround the indoor fan 7*f*. Thus, the indoor air suctioned by the indoor fan 7*f* from the air inlet 422 exchanges heat in the indoor heat exchanger 7, and is blown from the outside of the indoor heat exchanger 7 into the room (not illustrated) through the air outlets 423.

Flare joints 15*a* and 15*b* are disposed at one of the four corners of the housing 410, and the indoor heat exchanger 7 is connected to indoor pipes 9*a* and 9*b* at this corner. These connections are made in the same manner as in Embodiment 1 (brazed portions W, see FIG. 5), and therefore the description thereof will be omitted.

Further, similarly to Embodiment 4, a fourth leaked refrigerant receiver 97 is formed that covers the area vertically below the connection portions (the brazed portions W, see FIG. 5) between the indoor heat exchanger 7 and the indoor pipes 9*a* and 9*b* and the area vertically below the flare joint 15*a* and the flare joint 15*b* (imaginary lines formed by projecting vertically downward the positions of all the brazed portions W and the positions of the flare joints 15*a* and 15*b* intersect the fourth leaked refrigerant receiver 97). The fourth leaked refrigerant receiver 97 is a box with an open top, and includes a bottom surface parallel to a housing top surface 414. A third temperature sensor S6 is disposed close to the bottom surface in the fourth leaked refrigerant receiver 97.

Thus, similarly to the air-conditioning apparatus 200 (Embodiment 3), the air-conditioning apparatus 400 has the same advantageous effects as those of the air-conditioning apparatus 100 (Embodiment 1 and Embodiment 2).

In the above, the floor type (Embodiments 1 and 3), the ceiling suspended type (Embodiment 4), and the ceiling cassette type (Embodiment 5) have been described as those that implement Embodiment 2. However, it is possible to implement Embodiment 2 in a wall type indoor unit of an air conditioning apparatus as well, and the same advantageous effects are obtained.

Further, although the air-conditioning apparatuses 100 to 400 have been described above, the present invention is not limited thereto. For example, the present invention may include a refrigeration cycle apparatus including a water heater or another related component.

REFERENCE SIGNS LIST

1 control unit 2 operation display unit 3 compressor 4 four-way valve 5 outdoor heat exchanger 5*f* outdoor fan 6 expansion valve 7 indoor heat exchanger 7*f* indoor fan 8 outdoor pipe 8*a* outdoor pipe 8*b* outdoor pipe 8*c* outdoor pipe 8*d* outdoor pipe 9*a* indoor pipe 9*b* indoor pipe 10*a* extension pipe 10*b* extension pipe 11 suction pipe 12 discharge pipe 13*a* extension pipe connecting valve 13*b* extension pipe connecting valve 14*a* service port 14*b* service port 14*c* service port 15*a* flare joint 15*b* flare joint 16*a* flare joint 16*b* flare joint 20 partition plate 21 communication opening 70 radiator plate 71 heat-transfer pipe 71*a* end 71*b* end 72 hairpin 73 U-bend 80 holder 81 pipe holding part 82 arm part 83 sensor holding part 91*a* header main pipe 92*a* header branch pipe 92*b* indoor refrigerant branch pipe 93 first leaked refrigerant storing part 94 first leaked refrigerant receiver 95 second leaked refrigerant receiver 96 third leaked refrigerant receiver 97 fourth leaked refrigerant receiver 100 air-conditioning apparatus 101 indoor unit 102 outdoor unit 110 housing 111 housing front surface 112 air inlet 113 air outlet 114 housing top surface 115 housing rear surface 116 housing bottom surface 200 air-conditioning apparatus 201 indoor unit 300 air-conditioning apparatus 301 indoor unit 310 housing 311 housing front surface 312 air inlet 313 air outlet 314 housing top surface 315 housing rear surface 316 housing bottom surface 318 housing right end surface 400 air-conditioning apparatus 401 indoor unit 410 housing 414 housing top surface 416 housing bottom surface 420 decorative grille 422 air inlet 423 air outlet S1 inlet temperature sensor S2 liquid pipe sensor S3 two-phase pipe sensor S4 first temperature sensor S5 second temperature sensor S6 third temperature sensor W brazed portion

The invention claimed is:

1. An air-conditioning apparatus comprising:

an outdoor unit including at least a compressor and an outdoor pipe;

an indoor unit including at least an indoor heat exchanger, an indoor fan, and an indoor pipe;

an extension pipe connecting the outdoor pipe and the indoor pipe to each other;

a first temperature sensor disposed under a plurality of brazed portions connecting the indoor heat exchanger and the indoor pipe to each other; and a control unit configured to determine whether a refrigerant having a higher specific gravity than indoor air is leaking from any of the brazed portions, on the basis of a change in a temperature detected by the first temperature sensor, while the indoor fan is stopped, wherein a first leaked refrigerant receiver is disposed under the plurality of brazed portions and the first temperature sensor is disposed in the first leaked refrigerant receiver, the indoor heat exchanger includes a radiator plate and a heat-transfer pipe extending through the radiator plate, the indoor pipe comprises a gas-side indoor pipe and a liquid-side indoor pipe, a header main pipe and a header branch pipe that is connected to the header main pipe are positioned between the gas-side indoor pipe and the indoor heat exchanger, an indoor refrigerant branch pipe is positioned between the liquid-side indoor pipe and the indoor heat exchanger, and the plurality of brazed portions includes a brazed portion between the header main pipe and the header branch pipe, a brazed portion between the header branch pipe and a first end of the heat-transfer pipe, a brazed portion between a second end of the heat-transfer pipe and the indoor refrigerant branch pipe, and a brazed portion between the indoor refrigerant branch pipe and the liquid-side indoor pipe.

2. The air-conditioning apparatus of claim 1, further comprising:

a second temperature sensor disposed under a joint part connecting the indoor heat exchanger and the extension pipe to each other, wherein the control unit is configured to determine whether the refrigerant having the higher specific gravity than the indoor air is leaking from the joint part, on the basis of a change in a temperature detected by the second temperature sensor, while the indoor fan is stopped.

3. The air-conditioning apparatus of claim 2, wherein a second leaked refrigerant receiver is disposed under the joint part and the second temperature sensor is disposed in the second leaked refrigerant receiver.

4. The air-conditioning apparatus of claim 2, wherein a funnel-shaped receiver is disposed under the joint part, wherein the second temperature sensor is disposed under the funnel-shaped receiver, and wherein the second temperature sensor detects a temperature of the indoor air suctioned from a room while the indoor fan is in operation.

5. The air-conditioning apparatus of claim 1, further comprising:

a joint part connecting the indoor heat exchanger and the extension pipe to each other;

a leaked refrigerant receiver having a funnel shape disposed under the joint part; and an inlet temperature sensor disposed under the leaked refrigerant receiver, wherein the control unit is configured to determine whether the refrigerant having the higher specific gravity than the indoor air is leaking from the joint part, on the basis of a change in a temperature detected by the inlet temperature sensor, while the indoor fan is stopped.

6. The air-conditioning apparatus of claim 5, wherein the inlet temperature sensor detects the temperature of the indoor air suctioned from a room while the indoor fan is in operation.

7. The air-conditioning apparatus of claim 1, wherein the refrigerant is flammable.

8. The air-conditioning apparatus of claim 7, wherein the refrigerant is any one of HFC refrigerants of R32 (CH2F2; difluoromethane), HFO-1234yf (CF3CF═CH2; tetrafluoropropene), and HFO-1234ze (CF3-CH═CHF).

9. The air-conditioning apparatus of claim 4, wherein the funnel-shaped leaked refrigerant receiver is tapered such that an upper end of the funnel-shaped leaked refrigerant receiver is larger than a lower end of the funnel-shaped leaked refrigerant receiver.

10. The air-conditioning apparatus of claim 1, wherein the first temperature sensor detects a reduction in temperature due to evaporation of the refrigerant caused by the refrigerant leaking from any of the brazed portions, the first temperature sensor is in proximity to the fan such that operation of the indoor fan stirs air surrounding the first temperature sensor and prevents a concentration of the refrigerant in proximity to the first temperature sensor, which is caused by the refrigerant leaking from any of the brazed portions, the first temperature sensor is located such that the refrigerant that has leaked from any of the brazed portions concentrates in proximity to the first temperature sensor when the indoor fan is not operating, and the control unit is configured to determine whether the refrigerant is leaking from any of the brazed portions only when the indoor fan is stopped so that the refrigerant that leaks from any of the brazed portions will be concentrated in proximity to the first temperature sensor.

11. The air-conditioning apparatus of claim 2, wherein the second temperature sensor detects a reduction in temperature due to evaporation of the refrigerant caused by the refrigerant leaking from the joint part, the second temperature sensor is in proximity to the indoor fan such that operation of the indoor fan stirs air surrounding the second temperature sensor and prevents a concentration of the refrigerant in proximity to the second temperature sensor, which is caused by the refrigerant leaking from the joint part, the second temperature sensor is located such that the refrigerant that has leaked from the joint part concentrates in proximity to the second temperature sensor when the indoor fan is not operating, and the control unit is configured to determine whether the refrigerant is leaking from the joint part only when the indoor fan is stopped so that the refrigerant that leaks from the joint part will be concentrated in proximity to the second temperature sensor.

12. The air-conditioning apparatus of claim 5, wherein the inlet temperature sensor detects a reduction in temperature due to evaporation of the refrigerant caused by the refrigerant leaking from the joint part, the inlet temperature sensor is in proximity to the indoor fan such that operation of the indoor fan stirs air surrounding the inlet temperature sensor and prevents a concentration of the refrigerant in proximity to the inlet temperature sensor, which is caused by the refrigerant leaking from the joint part, the inlet temperature sensor is located such that the refrigerant that has leaked from the joint part concentrates in proximity to the inlet temperature sensor when the indoor fan is not operating, and the control unit is configured to determine whether the refrigerant is leaking from the joint part only when the indoor fan is stopped so that the refrigerant that leaks from the joint part will be concentrated in proximity to the inlet temperature sensor.

* * * * *